US005621510A

United States Patent [19]

Okuda et al.

[11] Patent Number: 5,621,510

[45] Date of Patent: Apr. 15, 1997

[54] IMAGE HEATING APPARATUS WITH DRIVING ROLLER HAVING LOW THERMAL EXPANSION COEFFICIENT OUTER LAYER

[75] Inventors: Kouichi Okuda; Tatsunori Ishiyama, both of Yokohama; Akira Hayakawa, Tokyo; Takashi Shibuya, Kawasaki; Hiroyuki Oba, Yokohama, all of Japan

[73] Assignee: Canon Kabushiki Kaisha, Tokyo, Japan

[21] Appl. No.: 365,031

[22] Filed: Dec. 28, 1994

[30] Foreign Application Priority Data

Dec. 28, 1993 [JP] Japan ..... 5-354637

[51] Int. Cl.[6] ..... G03G 15/20

[52] U.S. Cl. ..... 399/338; 219/216

[58] Field of Search ..... 355/282, 285, 355/290, 295; 219/469–471, 216; 432/60; 118/60

[56] References Cited

U.S. PATENT DOCUMENTS

| | | | |
|---|---|---|---|
| 4,515,884 | 5/1985 | Field et al. | 118/60 |
| 5,148,226 | 9/1992 | Setoriyama et al. . | |
| 5,253,024 | 10/1993 | Okuda et al. . | |
| 5,282,009 | 1/1994 | Derimiggio | 355/285 X |
| 5,365,314 | 11/1994 | Okuda et al. . | |
| 5,532,806 | 7/1996 | Sugita et al. | 355/285 |

*Primary Examiner*—Shuk Yin Lee

*Attorney, Agent, or Firm*—Fitzpatrick, Cella, Harper & Scinto

[57] ABSTRACT

An image heating apparatus includes a film contactable and movable together with a recording material carrying an unfixed image; a heater for increasing a temperature of the film, wherein the unfixed image is heated by heat from the film; driving roller contactable to the film to drive the film; wherein the driving roller have an elastic layer and a low thermal expansion coefficient layer outside the elastic layer.

24 Claims, 6 Drawing Sheets

IMAGE HEATING APPARATUS WITH DRIVING ROLLER HAVING LOW THERMAL EXPANSION COEFFICIENT OUTER LAYER

FIELD OF THE INVENTION AND RELATED ART

The present invention relates to an image heating apparatus usable as an image heating fixing apparatus or the like, in an image forming apparatus such as a copying machine, a laser beam printer, a facsimile machine, a microfilm reader-printer, and an image display apparatus.

In a widely used conventional heating apparatus for fixing an image on a recording material, fixing is done with a heating roller maintained at a predetermined temperature and a pressing roller having an elastic layer and press-contacted to the heating roller, wherein a recording material (material to be heated) is passed through a nip formed between the heating roller and the pressing roller (heat roller type). Additionally, there are used flash heating type, oven heating type, hot plate heating type or the like.

Recently, a film heating type has been proposed in U.S. Pat. No. 5,148,226 or the like in place of the above-described type. The film heating type uses a stationary heater, a heat resistive film (fixing film) press-contacted to the heater, and a pressing member for press-contacting the recording material to the heater through the film, wherein the heat from the heating member is applied to the recording material through the film by which the image is fixed on the recording material by heat.

In such a heating apparatus or an image heating apparatus of such a film heating type, a low thermal capacity heater is usable as the heating member. Therefore, as compared with the conventional contact heating type (heat roller type, belt heating type or the like), the power can be saved, and the waiting period can be reduced (quick start is possible). In addition, various drawbacks of the conventional heat fixing type can be avoided. In a heating apparatus as disclosed in U.S. Pat. No. 5,148,226, wherein a pressing roller of rubber material is driven to feed the fixing film and the recording material, when the temperature of the pressing roller increases, the outer diameter of the rubber portion increases by thermal expansion. Usually, the pressing roller is driven at a constant rotational speed, and the feeding speed for the recording material increases as compared with the low temperature state, when the temperature of the pressing roller increased, with the result of instable image fixing.

In an apparatus wherein the image transfer and the image fixing are effected simultaneously on the same recording material for the purpose of downsizing the apparatus, if the thermal expansion of pressing roller described above occurs, the fixing portion stretches the recording material when the recording material reaches the fixing position, with the result of the expansion of the image or the missing of the image at the trailing edge of the recording material. If the recording material feeding speed of the fixing apparatus is set from the beginning to a lower level in consideration of the above-described phenomenon, the recording material forms a loop in the feeding station when the temperature of the pressing roller is still low with the result of the entrance angle of the recording material or the like becomes instable at the entrance to the fixing apparatus or in the instable recording material separating direction after the image transfer. This may further results in image scattering upon the recording material separation, toner offset in the image fixing apparatus, contamination of the image by the rubbing of the recording material surface with adjacent parts in the apparatus. When a thick recording material is used, the image may be blurred in the transfer position.

SUMMARY OF THE INVENTION

Accordingly, it is a principal object of the present invention to provide an image heating apparatus in which the recording material carrying an unfixed image can be stably fed, and heated uniformly.

It is another object of the present invention to provide an image heating apparatus in which an image is not disturbed even if the size of the apparatus is reduced.

According to an aspect of the present invention, there is provided an image heating apparatus comprising: a film contactable and movable together with a recording material carrying an unfixed image; means for increasing a temperature of the film, wherein the unfixed image is heated by heat from the film; driving roller contactable to the film to drive the film; wherein the driving roller comprising an elastic layer and a low thermal expansion coefficient layer outside the elastic layer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 7:
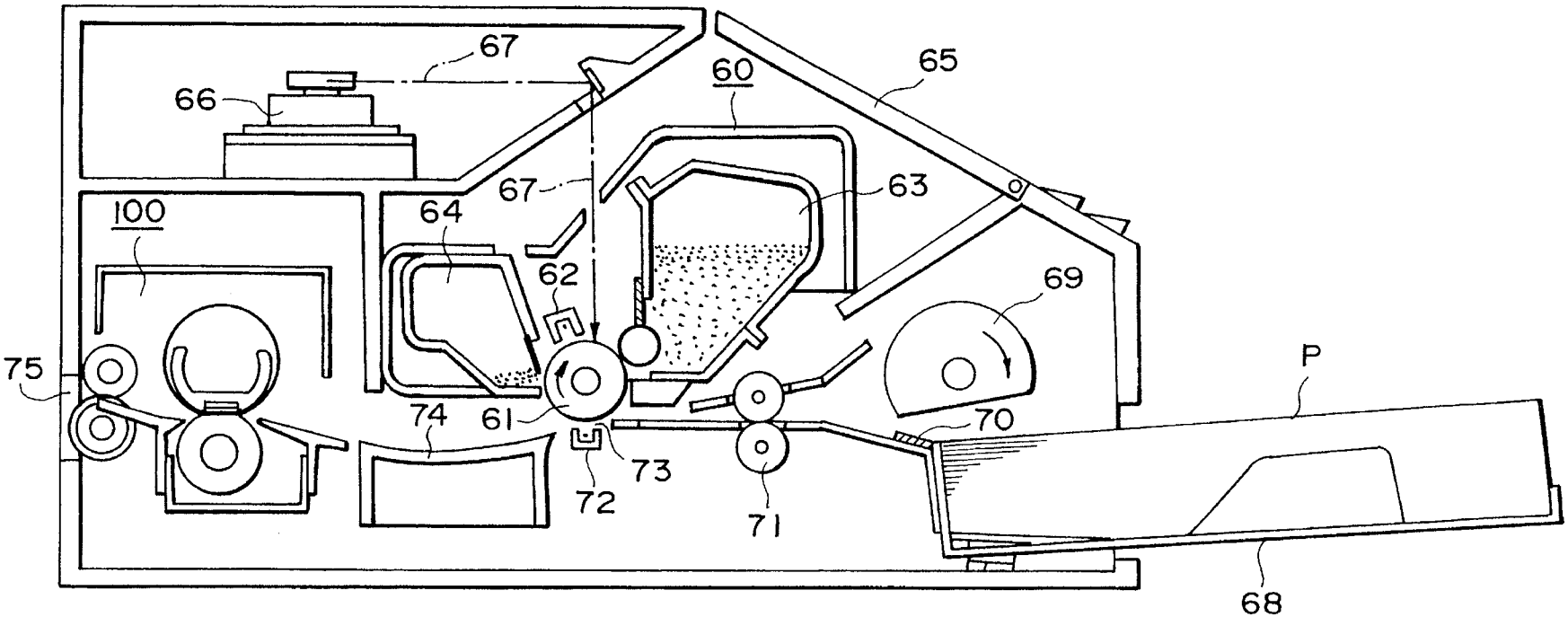
FIG. 7 illustrates an image forming apparatus using an image heating apparatus according to an embodiment of the present invention.
Figure 8:
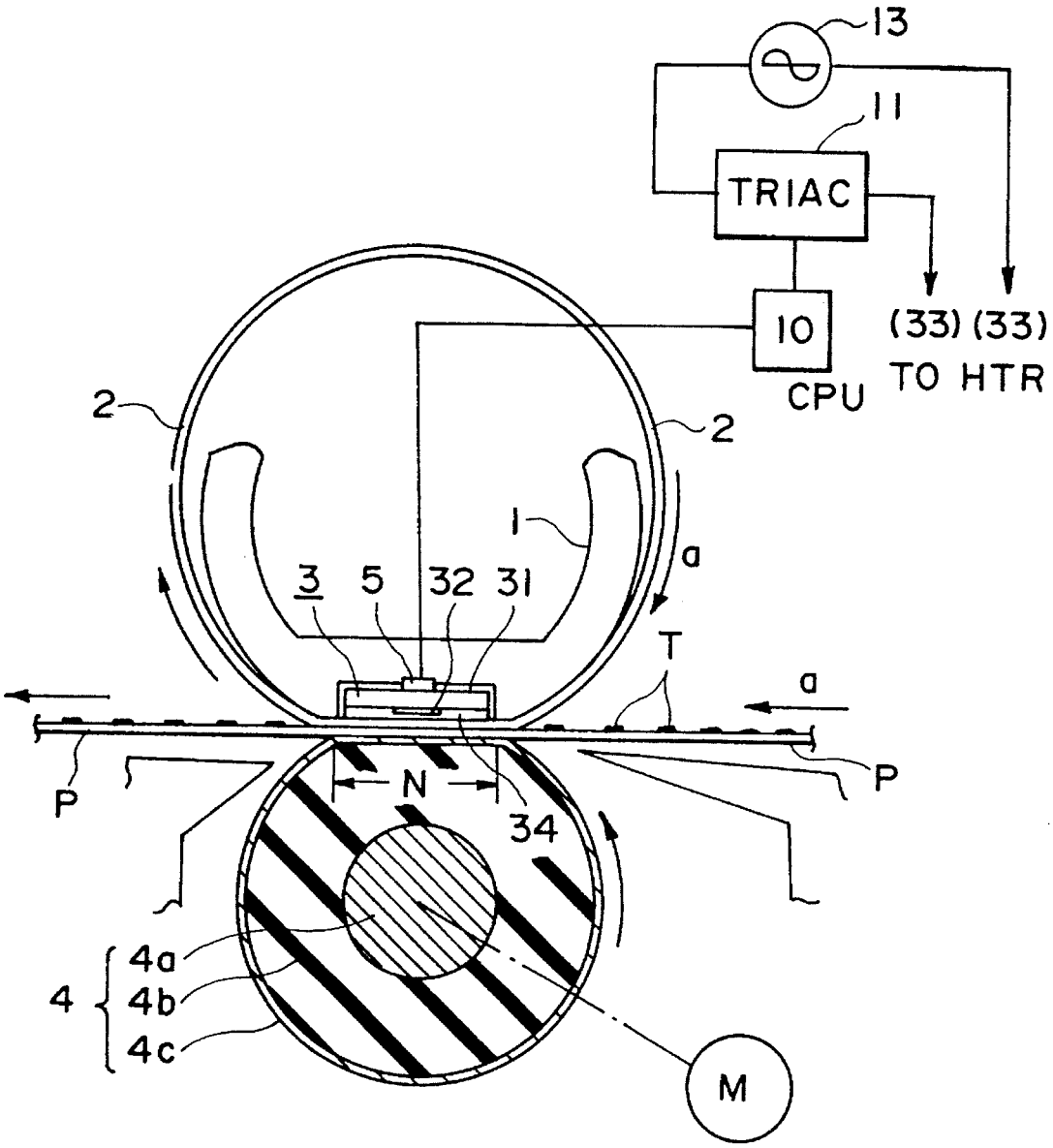
FIG. 8 illustrates an image heating apparatus according to another embodiment of FIG. 1.

FIG. 7 is a sectional view of an image forming apparatus using an image heating apparatus according to an embodiment of the present invention as a fixing apparatus.

In this embodiment, the image forming apparatus is in the form of a laser beam printer using an image transfer type electrophotographic process.

Designated by a reference numeral 60 is a process cartridge, which contains four process means, namely, a rotatable drum type electrophotographic photosensitive member (drum) 61, a charger 62, a developing device 63 and a cleaning device 64. By opening the main assembly of the apparatus at an opening portion 65, the process cartridge can be detachably mountable to a predetermined position in the main assembly.

Upon image formation start signal, the drum 61 is rotated in a clockwise direction indicated by an arrow, and a surface 61 of the rotating drum is uniformly charged to a predetermined potential and polarity, and a laser scanner 66 projects, onto the charged surface, a laser beam 67 modulated in accordance with time series electric digital pixel signals corresponding to intended image information (main scan exposure), by which an electrostatic latent image is formed corresponding to the intended image information, on the surface of the drum 61. The latent image is visualized into a toner image by a developing device 63.

A recording material P is fed out of a sheet feeding cassette 68 by cooperation of a feeding roller 69 and a separation pad 70, one by one. The recording material is fed to a transfer charger 72 press-contacted to the drum 61 in synchronism with the rotation of the drum 61, by a pair of registration rollers 71. Then, the toner image is sequentially transferred onto the surface of the recording material P from the drum surface.

The recording material P passing through the transfer station 73 is separated from the surface of the drum 61, and is introduced into an image fixing apparatus 100 along a guide 74. The unfixed toner image is heated and fixed, and the recording material P is discharged through the discharge outlet 75.

The surface of the drum 61 from which the recording material P is separated through the transfer station 73, is cleaned by a cleaning device 64 so that residual toner or the like is removed, and is prepared for the repeated image formation.

According to this embodiment, in the case that at least a maximum size recording material is used, the leading edge of the recording material starts to be subjected to the fixing operation prior to the completion of the image transfer onto the recording material.

Figure 1:
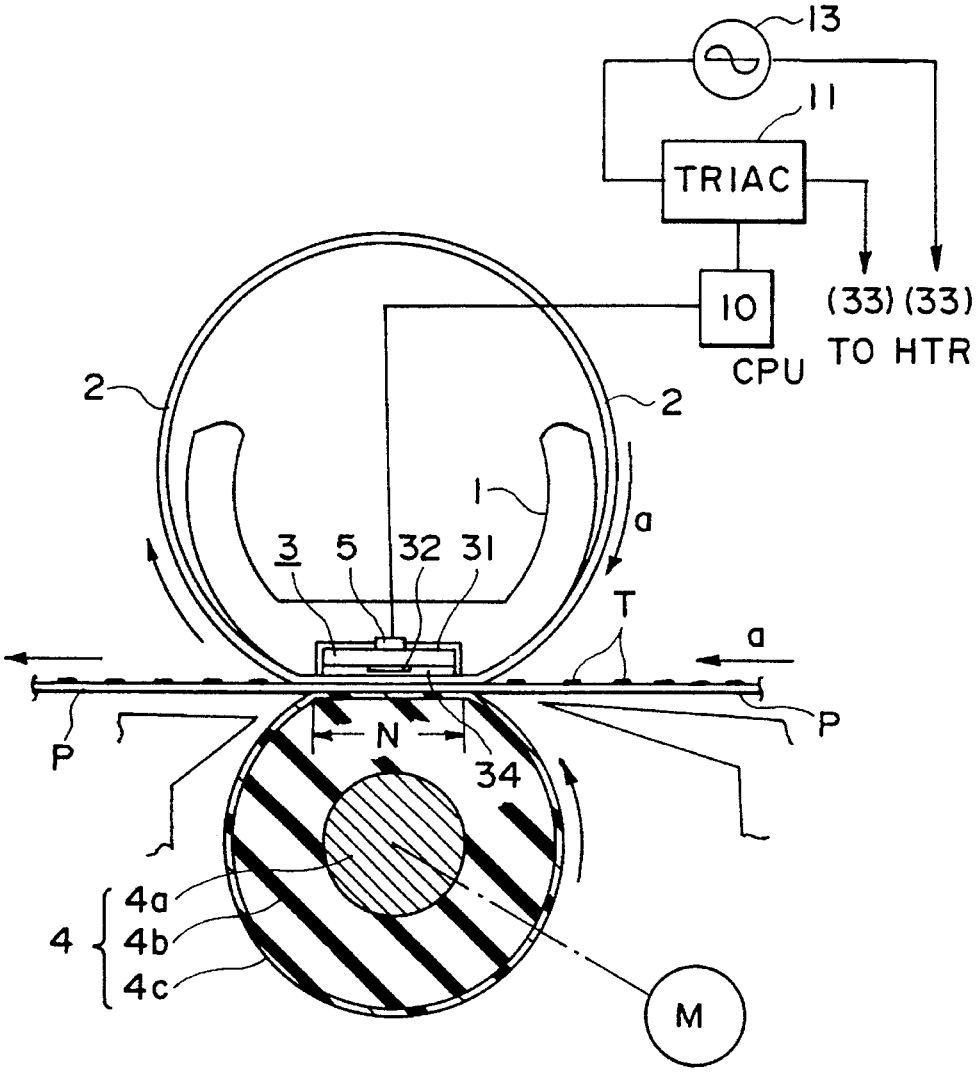
FIG. 1 illustrates an image heating apparatus according to an embodiment of the present invention.
Figure 2:
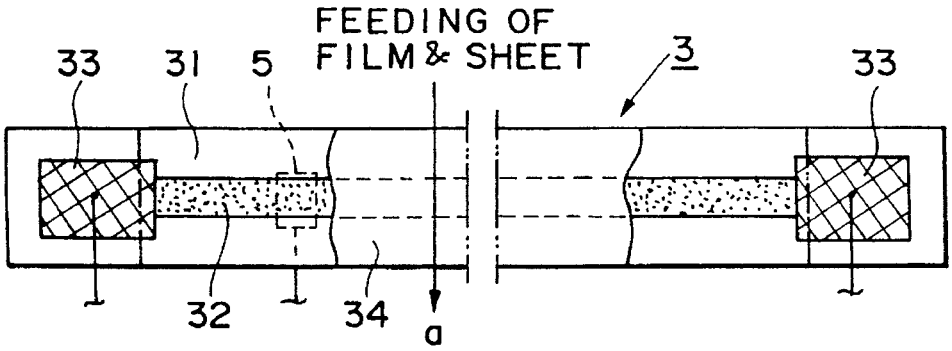
FIG. 2 illustrates a heater.

Referring to FIGS. 1 and 2, the fixing apparatus 100 will be described in detail.

FIG. 1 is a sectional view of a film heating type image heating apparatus according to an embodiment of the present invention. FIG. 2 is a top plan view partly broken, of a heater used in the apparatus of FIG. 1. The apparatus is a tensionless type apparatus disclosed in U.S. Pat. No. 5,148,226.

In the tensionless type apparatus, a heat resistive film in the form of an endless belt or cylinder, is used. At least a part of the circumference of the film is always maintained tension free (without tension), and the film is driven by a driving force by the pressing member 4.

The endless heat resistive film 2 is supported on the outer surface of a stay 1 (film guiding member) containing a heater 3. The inner circumferential length of the heat resistive film and the outer circumferential length of the stay 1 are such that the inner circumferential length of the film 2 is about 3 mm larger, so that the film 2 is loosely supported on the stay 1.

For the purpose of improving the quick-start property by decreasing the thermal capacity of the film 2, the film thickness is not more than 100 μm, preferably not more than 50 μm and not less than 20 μm. It is of heat resistive material such as, polytetrafluoroethylene (PTFE), tetrafluoroethylene-perfluoroalkylvinylether copolymer (PFA), fluorinated ethylenepropylene (FEP) or the like in the form of a single layer film. It may be a multi-layer film comprising, for example, polyimide, polyamide, polyetheretherketone (PEEK), polyether-sulfone (PES), polyphenylene sulfide (PPS) or the like, resin film, and PTFE, PFA, FEP or the like thereon. In this embodiment, the use is made with a polyimide film having an outer surface coated with PTFE.

The heater 3 functioning to increase the temperature of the film 2 comprises an elongated base plate 31 of heat resistive, electrically insulative and high thermal conductivity and extended in a direction substantially perpendicular to a feeding direction A of the recording material or the feeding direction of the heat resistive film 2, and a heat generating resistor 32 formed along the length of the base plate at the center of the surface of the substrate, and a heat resistive overcoating layer 34 for protecting a surface of the heater having the heat generating resistor, electric power Supply electrodes 33 and 33 (FIG. 2) at the opposite longitudinal ends of the heat generating resistor 32, and a temperature sensor 5 such as a thermister for detecting heater temperature at the backside of the base plate. The heater as a whole has a low thermal capacity and is in the form of a linear heating member.

The surface having the heat generating resistor 32 is faced downwardly, and is fixed to the bottom surface of the stay having sufficient rigidity and heat resistance property.

The heater base 31 is of, for example, alumina, aluminum nitride or the like having a thickness of 1 mm, width of 10 mm and a length of 240 mm.

The heat generating resistor 32 is of electric resistance material such as Ag/Pd (silver palladium), $RuO_2$, $Ta_2N$ or the like, screen-printed into a line or stripe with a thickness of approx. 10 μm and a width of 1–3 mm.

Electrodes 33 and 33 are screen-printed pattern layer of Ag or the like.

The overcoating layer 34 is a heat resistive glass layer having a thickness of approx. 10 μm. The pressing roller 4 cooperates with the heater 3 to form a nip N (fixing nip) with the film sandwiched therebetween and functions to move the film 2 by outer peripheral contact.

The pressing roller 4 functioning also as a film driving roller comprises a core metal 4*a*, and elastic layer 4*b* of silicone rubber or the like, and an outer surface layer 4*c* of low thermal expansion property. It is supported by bearing means and urging means to press-contact the film 2 to the heater 3 surface. It is driven in a counterclockwise direction indicated by an arrow by driving means M.

The rotational force acts on the film by friction between the film outer surface and the roller when the pressing roller 4 is rotated.

The temperature of the heater 3 increases by heat generation, over the entire length, of the heat generating resistor 32 by the electric power supply to the heat generating resistor 32 at the electrodes 33 and 33. The temperature rise is sensed by a temperature sensor 5. The output of the temperature sensor 5 is introduced to CPU 10 after A/D conversion. On the basis of the information, the AC voltage of the AC voltage source 13 for supplying electric power to the heat generating resistor 32 is controlled by triac 11. By controlling the phase, the number of waves of the electric power supply, the temperature of the heater 3 is controlled.

More particularly, when the temperature sensor 5 senses a temperature lower than a predetermined temperature, the temperature of the heater is increased, and if it is higher, the temperature of the heater 3 is decreased, by which the temperature of the heater 3 is maintained constant during the image fixing operation.

When the temperature of the heater 3 reaches a predetermined level, and the peripheral speed of the film 2 by the pressing roller 4 is stabilized, a recording material P (material to be heated) is introduced from an image forming station (transfer station) of FIG. 7 into a nip between the film 2 and the pressing roller 4. The recording material P is fed through the nip together with the film 2, so that the heat is transferred from the heater 3 to the recording material P to fix the unfixed image (toner image) T on the recording material P surface. The recording material P having passed through the nip N is separated from the surface of the film 2.

The thickness of the elastic layer 4*b* of the roller 4 is nut more than 20 μm, and the hardness is not more than JIS-A 30 degrees (test piece).

The low thermal expansion 4*c* is of polyimide resin material, and exhibits a low thermal expansion and exhibits high elasticity at high temperature.

Figure 3:
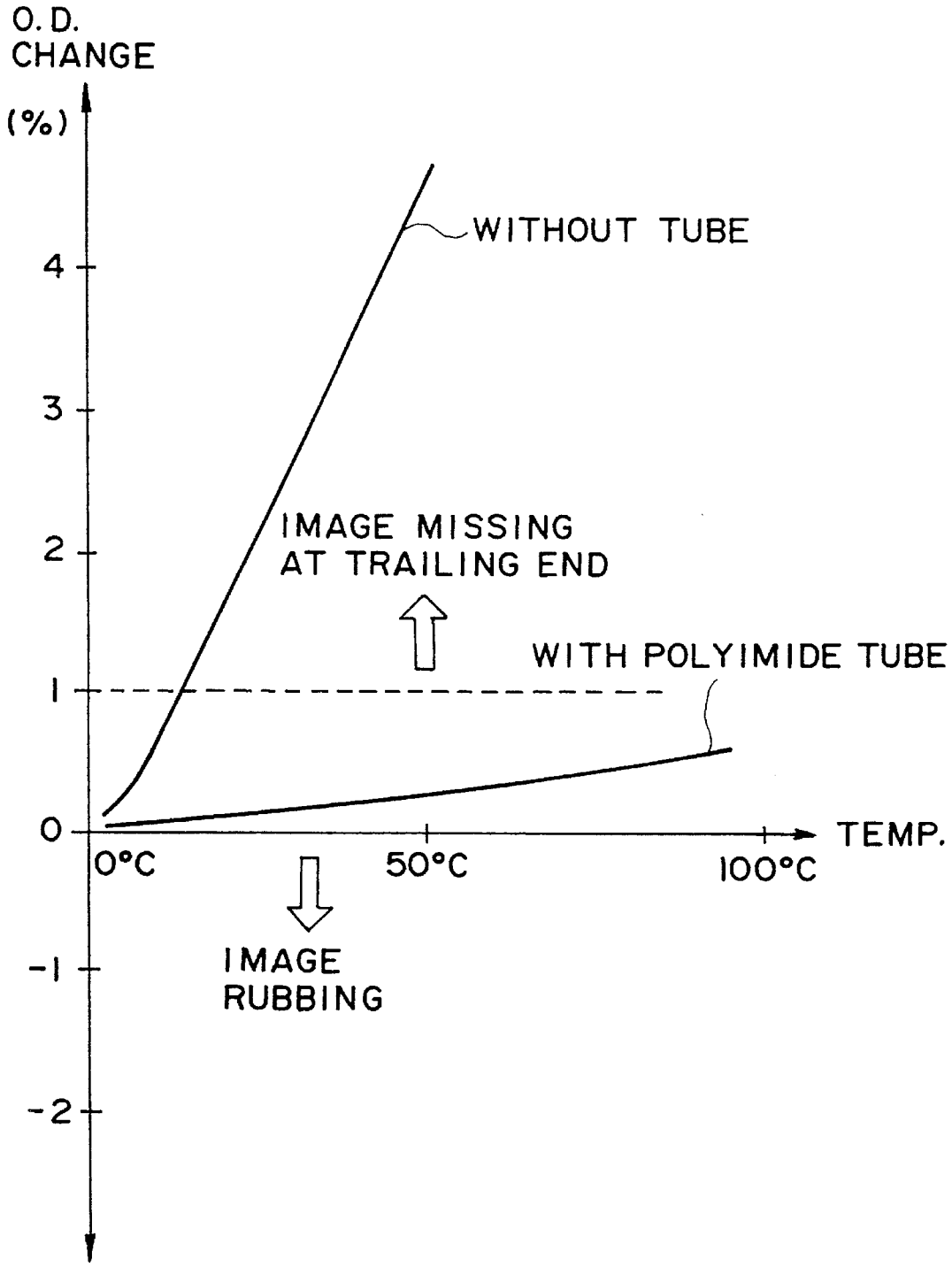
FIG. 3 illustrates a relationship between a temperature of a pressing roller and a change of an outer diameter thereof.

FIG. 3 shows changes of the outer diameter of the pressing roller 4 when it is coated with a polyimide tube as a low thermal expansion layer 4*c* and when it is not coated with it.

Without the tube, the silicone rubber (elastic layer 4*b*) expands with the temperature rise with the result of increase of the outer diameter of the pressing roller 4. When the increase exceeds 1% in the apparatus of FIG. 1, the recording material (a sheet of paper) P is pulled by the fixing apparatus with the result of increased sheet feeding speed, and therefore the image is missing at the trailing edge.

In order to prevent this, if the roller diameter (called state) is reduced, the image is rubbed by production of sheet loop.

In the case that the low thermal expansion layer 4*c* is provided, the increase of the outer diameter is low even if the temperature of the pressing roller 4 decreases. Therefore, the image missing does not occur in any case.

Figure 4:
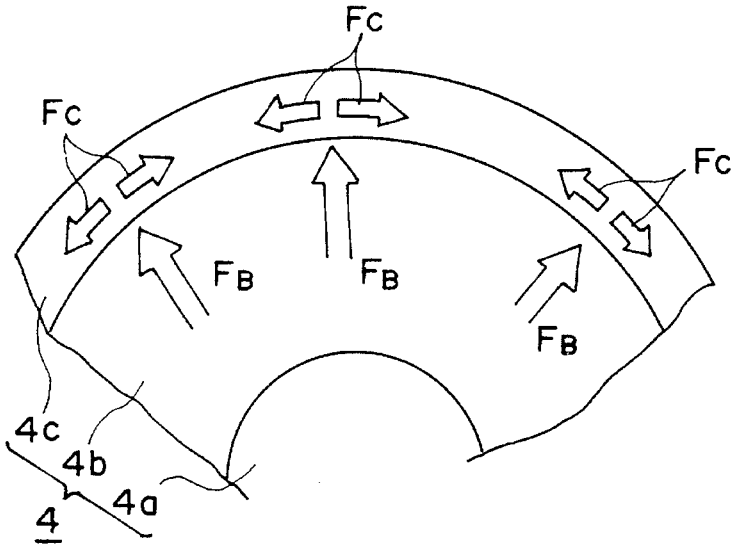
FIG. 4 illustrates suppression of the outer diameter change of the pressing roller by low thermal expansion layer.

Referring to FIG. 4, the mechanism will be described. When the elastic layer 4*b* expands, the force FB for raising the low thermal expansion layer is produced. By this, the force FC is produced to expand the low thermal expansion layer 4*c* in the circumferential direction. At this time, if the thermo-expansion coefficient of the low thermal expansion layer 4*c* is low and the elasticity is very high, the low thermal expansion layer 4*c* does not expand so that the expansion of the elastic layer 4*b* is suppressed.

Figure 5:
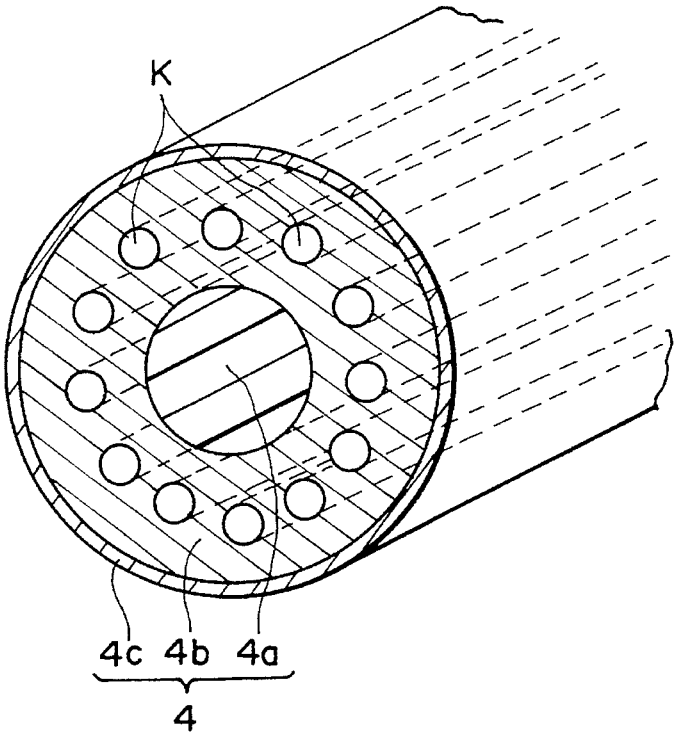
FIG. 5 illustrates a pressing roller having a bore.

The elastic layer 4*b* of foamed or non-foamed rubber, or may be provided with a certain number of cavities k extending in the longitudinal direction, in the elastic layer 4*b*, as shown in FIG. 5. If the foamed material or the material having the cavities, is used, the expansion force of the elastic layer can be reduced, and therefore, the diameter change due to the temperature can be reduced even if the thickness of the low thermal expansion layer 4*c* is reduced, or if the thickness of the elastic layer 4*b* is increased. Therefore, the image fixing property can be increased by lowering the hardness of the pressing roller to increase the nip width.

The thermal expansion rate of the low thermal expansion layer 4*c* is preferably not more than 100 ppm/° C., and the elasticity is not less than 100 kg/mm (t=100 ° C.). The table gives examples of film thickness of the tube effective to avoid the trailing edge image missing (the outer diameter change is not more than 1% when the pressing roller temperature increases from 25° C. to 100° C.) when the low thermal expansion tube is used, and the roller hardness and the fixing properties.

When PFA tube without filler is used, the thermal expansion coefficient is as high as 130 ppm/° C., and therefore, the outer diameter change exceeds 1% by the thermal expansion of the tube 4*c* alone, even if there were no pressure from the elastic layer 4*b*.

By containing short glass fibers in PFA material, the thermal expansion is decreased and the elasticity is increased. For example, the content of the glass fiber is 25%, the elasticity is 106 kg/mm$^2$, the thermal expansion is 91 ppm/° C. Then, 50 mm of the tube film thickness is enough to avoid the trailing edge image missing. In addition, the hardness of the pressing roller is decreased to approx. 60 degrees (Asker C), and therefore, good image fixing properties can be provided.

When the tube is of polyamide or aramid, the elasticity and the thermal expansion coefficient are both improved so that the tube film thickness and the roller hardness can be both lowered, and therefore, the fixing properties can be further improved.

TABLE 1

| Tubes | Elasticity (T = 100° C.) | Thermal expansion coefficient |
|---|---|---|
| No | — | — |
| PFA (no filler) | 20 (kg/mm$^2$) | 137 (PPM/°C.) |
| PFA (glass fiber 15%) | 69 | 103 |
| PFA (glass fiber 25%) | 106 | 91 |
| Polyimide | 183 | 20 |
| Aramid | 900 | 20 |
| **Thickness required to make dia. change 1% or lower from 25 to 100° C.** | **Roller hardness** | **Fixing performance** |
| — | ASKER-C 45° | — |
| No | — | — |
| 100 μ | 73° | NG |
| 50 μ | 60° | G |
| 25 μ | 55° | E |
| ≦10 μ | 55° | E |

When the low thermal expansion layer 4*c* is coated with parting layer of fluorine resin such as PFA, PTFE, FEP or the like or silicone resin or rubber, the toner is prevented from being deposited on the surface of the pressing roller 4, so that the jamming resulting from wrapping of the paper around the pressing roller 4, can be avoided. The parting layer may of electroconductivity.

A filler material or the like may be dispersed in the elastic layer 4*b* or a low thermal expansion layer 4*c* to provide electroconductivity.

A metal film is usable as a low thermal expansion layer.

As described in the foregoing, according to this embodiment, the pressing roller for driving the film is provided with a polyimide tube as a low thermal expansion layer, on the elastic layer, and therefore, the thermal expansion of the elastic layer can be suppressed by the polyimide tube, and therefore, the instability of the image fixing due to the variation of the feeding speed for the film and the recording material resulting from the change in the roller diameter cam be avoided.

The polyimide tube of this embodiment has a high elasticity, and therefore, the elastic layer can be firmly confined.

When the driving roller is eta position opposed to the heater, as in this embodiment, the driving roller is easily influenced by the heat from the heater, and therefore, the structure of this embodiment is extremely effective.

According to this embodiment, the feeding of the recording material can be stabilized, and therefore, the fixing operation is possible at the leading edge of the same recording material during the image transfer operation onto the recording material, and therefore, the distance between the image transfer station and the image fixing station can be reduced, thus permitting downsizing of the apparatus.

Figure 6:
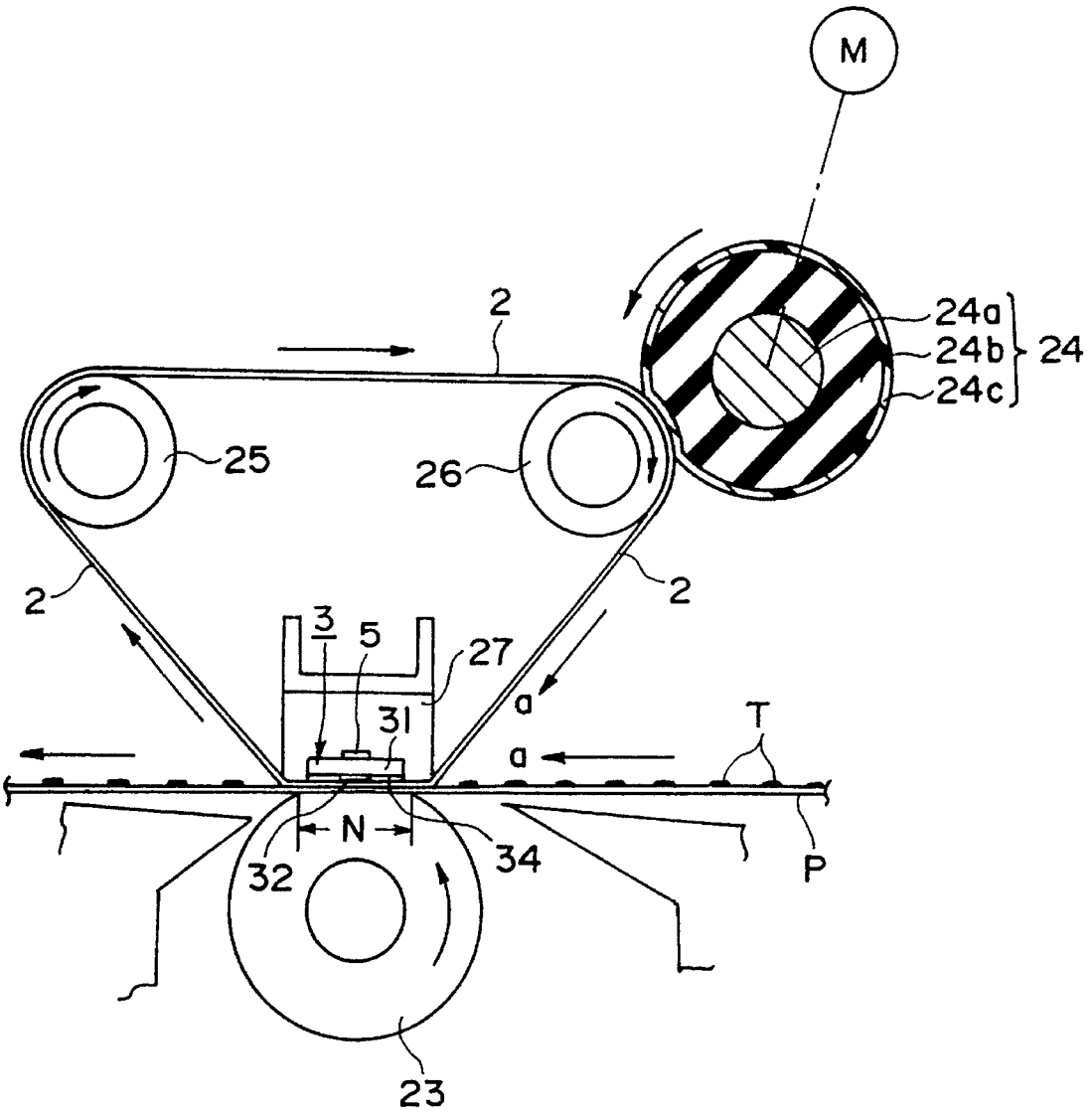
FIG. 6 illustrates an image heating apparatus according to another embodiment of the present invention.

Referring to FIG. 6, another embodiment will be described.

In the apparatus of FIG. 6, a film tension type is used. An endless heat resist film 2 is extended and stretched around parallel three members, more particularly, two follower rollers 25 and 26, a heater 3 fixed on a heater support 27 of heat resistivity and heat insulation.

Designated by a numeral 23 is a pressing roller to press-contact the heater 2 to the film, and in this embodiment, it is rotated by the rotation of the film 2.

Designated by a numeral 24 is a film driving roller contactable the outer surface of the film to press-contact the film 2 to the follower roller 26. By the rotation of the roller 24 in the counterclockwise direction by the driving means M, the film 2 is rotated in the clockwise direction. By the rotation of the film, the rollers 25, 26 and 23 are rotated.

The driving roller 24, similarly to the pressing roller 4 in the foregoing embodiment, comprises a core metal 24*a*, an elastic layer 24*b* of heat resistive rubber such as silicone rubber, and a surface low thermal expansion layer 24*c* of high elasticity.

As for the low thermal expansion layer, polyimide, aramid PFA (containing 25% of glassfiber) in the form of tube is usable.

As described in the foregoing, similarly to the first embodiment, the recording material can be stably fed without image expansion, trailing edge missing, image disturbance, can be avoided, according to this embodiment.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

a film contactable and movable together with a recording material carrying an unfixed image;

means for increasing a temperature of said film, wherein the unfixed image is heated by heat from said film;

driving roller contactable to said film to drive said film;

wherein said driving roller comprising an elastic layer and a low thermal expansion coefficient layer outside said elastic layer.

2. An apparatus according to claim 1, wherein said low thermal expansion coefficient layer is of polyimide material.

3. An apparatus according to claim 1, wherein said low thermal expansion coefficient layer is of aramid.

4. An apparatus according to claim 1, wherein said low thermal expansion coefficient layer is of copolymer of tetrafloroethylene and perfluoroalkylvinylether containing 25% of glass fiber material.

5. An apparatus according to claim 1, 3 or 4, wherein said low thermal expansion coefficient layer is in the form of a tube.

6. An apparatus according to claim 1, wherein said low thermal expansion coefficient layer has a thermal expansion coefficient of less than 100 ppm/° C.

7. An apparatus according to claim 1, wherein said low thermal expansion coefficient layer has an elasticity of not less than 100 kg/mm$^2$.

8. An apparatus according to claim 1, wherein said elastic layer is of silicone rubber.

9. An apparatus according to claim 1, wherein the recording material is passed through a nip formed between said driving roller and said film.

10. An apparatus according to claim 1, further comprising a pressing roller for forming a nip with said film, and the recording material is passed through the nip.

11. An apparatus according to claim 1, wherein said film temperature increasing means includes a heater.

12. An apparatus according to claim 11, wherein said driving roller forms a nip with said heater through said film.

13. An apparatus according to claim 1, wherein said low thermal expansion layer is of metal.

14. An image heating apparatus, comprising:

a first rotatable member; and a second rotatable member contacted to said first rotatable member to drive said first rotatable member;

wherein said first rotatable member and said second rotatable member form a nip which is effective to feed a recording material carrying an image while heating the image; and wherein said second rotatable member has an elastic layer and a low thermal expansion layer outside said elastic layer.

15. An apparatus according to claim 14, wherein said low thermal expansion coefficient layer is of polyimide material.

16. An apparatus according to claim 14, wherein said low thermal expansion coefficient layer is of aramid.

17. An apparatus according to claim 14, wherein said low thermal expansion coefficient layer is of copolymer of tetrafloroethylene and perfluoroalkylvinylether containing 25% of glass fiber material.

18. An apparatus according to claims 14, 15, 16 or 17, wherein said low thermal expansion coefficient layer is in the form of a tube.

19. An apparatus according to claim 14, wherein said low thermal expansion coefficient layer has a thermal expansion coefficient of less than 100 ppm/° C.

20. An apparatus according to claim 14, wherein said low thermal expansion coefficient layer has an elasticity of not less than 100 kg/mm$^2$.

21. An apparatus according to claim 14, wherein said elastic layer is of silicone rubber.

22. An apparatus according to claim 14, wherein said low thermal expansion layer is of metal.

23. An apparatus according to claim 14, wherein said first rotatable member contains a heater therein.

24. An apparatus according to claim 14, wherein said second rotatable member is in the form of a roller.

* * * * *

UNITED STATES PATENT AND TRADEMARK OFFICE

CERTIFICATE OF CORRECTION

PATENT NO. : 5,621,510
DATED : April 15, 1997
INVENTOR(S) : Kouichi OKUDA, et al.

It is certified that error appears in the above-indentified patent and that said Letters Patent is hereby corrected as shown below:

COLUMN 1

Line 49, delete "increased" and insert therefor --increases--;
Line 53, after "of", insert --the--;
Line 62, delete "of", first occurrence, and insert therefor --that--;
Line 66, delete "results" and insert therefor --result--.

COLUMN 2

Line 1, after "tus,", insert --or--;
Line 20, after "film;", insert --a--;
Line 21, delete "comprising" and insert therefor --comprises--;

COLUMN 4

Line 10, delete "Supply" and insert therefor --supply--;
Line 21, after "mm,", insert --a--.

COLUMN 5

Line 8, delete "nut" and insert therefor --not--.

UNITED STATES PATENT AND TRADEMARK OFFICE

CERTIFICATE OF CORRECTION

PATENT NO. : 5,621,510

DATED : April 15, 1997

INVENTOR(S) : Kouichi OKUDA, et al.

It is certified that error appears in the above-indentified patent and that said Letters Patent is hereby corrected as shown below:

COLUMN 7

Line 43, delete "comprising" and insert therefor --comprises--;
Line 52, delete "tetrafloroethylene" and insert therefor --tetrafluoroethylene--;
Line 55, after "1,", insert --2,--.

COLUMN 8

Line 37, delete "tetrafloroethylene" and insert therefor --tetrafluoroethylene--.

Signed and Sealed this

Third Day of February, 1998

*Attest:*

BRUCE LEHMAN

*Attesting Officer*

*Commissioner of Patents and Trademarks*